US010170038B2

(12) United States Patent
Jeon et al.

(10) Patent No.: US 10,170,038 B2
(45) Date of Patent: Jan. 1, 2019

(54) ORGANIC LIGHT EMITTING DIODE DISPLAY

(71) Applicant: Samsung Display Co., Ltd., Yongin-si, Gyeonggi-do (KR)

(72) Inventors: Mu Kyung Jeon, Ulsan (KR); Hee Rim Song, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 364 days.

(21) Appl. No.: 15/011,102

(22) Filed: Jan. 29, 2016

(65) Prior Publication Data

US 2016/0232849 A1 Aug. 11, 2016

(30) Foreign Application Priority Data

Feb. 5, 2015 (KR) ..... 10-2015-0018151

(51) Int. Cl.
*G09G 3/36* (2006.01)
*G09G 3/3233* (2016.01)

(52) U.S. Cl.
CPC ... *G09G 3/3233* (2013.01); *G09G 2300/0426* (2013.01); *G09G 2300/0842* (2013.01); *G09G 2300/0861* (2013.01); *G09G 2310/0262* (2013.01); *G09G 2320/0247* (2013.01)

(58) Field of Classification Search
CPC .. G09G 3/36; G09G 3/34; G09G 3/30; G09G 5/00; G06F 3/038
See application file for complete search history.

(56) References Cited

U.S. PATENT DOCUMENTS

2008/0036371 A1* 2/2008 Kim ..... G09G 3/3233 313/504
2012/0019504 A1* 1/2012 Han ..... G09G 3/3233 345/212
2014/0353629 A1* 12/2014 Jin ..... H01L 27/3262 257/40

FOREIGN PATENT DOCUMENTS

KR 10-2006-0089977 A 8/2006
KR 10-2009-0004635 A 1/2009
KR 10-2010-0093450 A 8/2010
KR 10-2012-0069137 A 6/2012
KR 10-2012-0074422 A 7/2012

* cited by examiner

*Primary Examiner* — Pegeman Karimi
(74) *Attorney, Agent, or Firm* — Lewis Roca Rothgerber Christie LLP

(57) ABSTRACT

An organic light emitting diode display includes: a substrate, a scan line and a previous stage scan line on the substrate to transmit scan signals; a data line and a driving voltage line crossing the scan line and to transmit a data voltage and a driving voltage, respectively; an initialization transistor connected to the previous stage scan line and the driving voltage line, and including an initialization drain electrode connected to a driving gate electrode of a driving transistor; a compensation transistor connected to the scan line and including a compensation drain electrode connected to the initialization drain electrode; and an organic light emitting diode electrically connected to the driving transistor, wherein at least one of the initialization transistor and the compensation transistor includes a plurality of gate electrodes.

17 Claims, 11 Drawing Sheets

ORGANIC LIGHT EMITTING DIODE DISPLAY

CROSS-REFERENCE TO RELATED APPLICATION

This application claims priority to and the benefit of Korean Patent Application No. 10-2015-0018151 filed in the Korean Intellectual Property Office on Feb. 5, 2015, the entire contents of which are incorporated herein by reference.

BACKGROUND

1. Field

Aspects of one or more example embodiments of the present invention relate to an organic light emitting diode display.

2. Description of the Related Art

An organic light emitting diode display includes two electrodes and an organic emitting layer disposed between the two electrodes. Electrons which are injected from one electrode and holes which are injected from the other electrode are combined in the organic emitting layer to form excitons, and the excitons emit energy, thereby emitting light.

Such an organic light emitting diode display includes a plurality of pixels, each pixel including an organic light emitting diode, which is a self-emitting element, a plurality of transistors, which drives the organic light emitting diode, and a storage capacitor. The plurality of transistors basically includes a switching transistor and a driving transistor.

The above information disclosed in this Background section is only for enhancement of understanding of the background of the invention, and therefore, it may contain information that does not form prior art.

SUMMARY

A compensation transistor and an initialization transistor may be disposed in a leakage current path of the storage capacitor so that a high data voltage Vds is applied. Therefore, it may be desirable to reduce leakage current of the compensation transistor and the initialization transistor to reduce flicker.

Aspects of some example embodiments provide an organic light emitting diode display which reduces leakage current of a compensation transistor and an initialization transistor to reduce flicker.

An exemplary embodiment of the present invention provides an organic light emitting diode display including: a substrate, a scan line and a previous stage scan line on the substrate and configured to transmit scan signals; a data line and a driving voltage line crossing the scan line and configured to transmit a data voltage and a driving voltage, respectively; an initialization transistor connected to the previous stage scan line and the driving voltage line, and including an initialization drain electrode connected to a driving gate electrode of a driving transistor; a compensation transistor connected to the scan line and including a compensation drain electrode connected to the initialization drain electrode; and an organic light emitting diode electrically connected to the driving transistor, wherein at least one of the initialization transistor and the compensation transistor includes a plurality of gate electrodes.

The initialization transistor may include: a first initialization transistor including a first initialization channel, a first initialization gate electrode, a first initialization source electrode, and a first initialization drain electrode; and a second initialization transistor including a second initialization channel, a second initialization gate electrode, a second initialization source electrode, and a second initialization drain electrode.

The initialization transistor may further include a third initialization transistor including a third initialization channel, a third initialization gate electrode, a third initialization source electrode, and a third initialization drain electrode.

The initialization transistor may further include a fourth initialization transistor including a fourth initialization channel, a fourth initialization gate electrode, a fourth initialization source electrode, and a fourth initialization drain electrode.

The initialization transistor may further include a fifth initialization transistor including a fifth initialization channel, a fifth initialization gate electrode, a fifth initialization source electrode, and a fifth initialization drain electrode.

The compensation transistor may include: a first compensation transistor including a first compensation channel, a first compensation gate electrode, a first compensation source electrode, and a first compensation drain electrode; and a second compensation transistor including a second compensation channel, a second compensation gate electrode, a second compensation source electrode, and a second compensation drain electrode.

The compensation transistor may further include a third compensation transistor including a third compensation channel, a third compensation gate electrode, a third compensation source electrode, and a third compensation drain electrode.

The organic light emitting diode display may include a plurality of pixels, and the plurality of pixels may include: a first pixel including an initialization transistor having two initialization gate electrodes, and a compensation transistor having two compensation gate electrodes; a second pixel including an initialization transistor having three initialization gate electrodes, and a compensation transistor having two compensation gate electrodes; and a third pixel including an initialization transistor having three initialization gate electrodes, and a compensation transistor having three compensation gate electrodes.

The plurality of pixels may further include: a fourth pixel including an initialization transistor having four initialization gate electrodes, and a compensation transistor having three compensation gate electrodes.

The plurality of pixels may further include: a fifth pixel including an initialization transistor having five initialization gate electrodes, and a compensation transistor having three compensation gate electrodes.

The first pixel to the fifth pixel may be disposed for every substrate position corresponding to a voltage drop of an initialization voltage.

The organic light emitting diode display may further include an initialization voltage line configured to transmit an initialization voltage through the initialization transistor to initialize the driving transistor.

A width of the initialization voltage line may vary according to a number of gate electrodes of the initialization transistor and the compensation transistor, or a position of a panel.

The width of the initialization voltage line may increase as the number of gate electrodes is increased.

According to aspects of one or more exemplary embodiments of the present invention, the compensation transistor and the initialization transistor are formed to have a plurality of gate electrodes to minimize or reduce the leakage current of the compensation transistor and the initialization transistor, thereby reducing flicker.

Further, the initialization voltage drop is measured and the compensation transistor and the initialization transistor having different numbers of gate electrodes are differentially disposed for every panel position, and the width of the initialization wire varies to provide an environment where a possibility of stain caused by the initialization voltage drop is minimized or substantially minimized.

BRIEF DESCRIPTION OF THE DRAWINGS

The above and/or other aspects and features of the present invention will become apparent to those skilled in the art from the following detailed description of the example embodiments with reference to the accompanying drawings.

DETAILED DESCRIPTION

Figure 1:
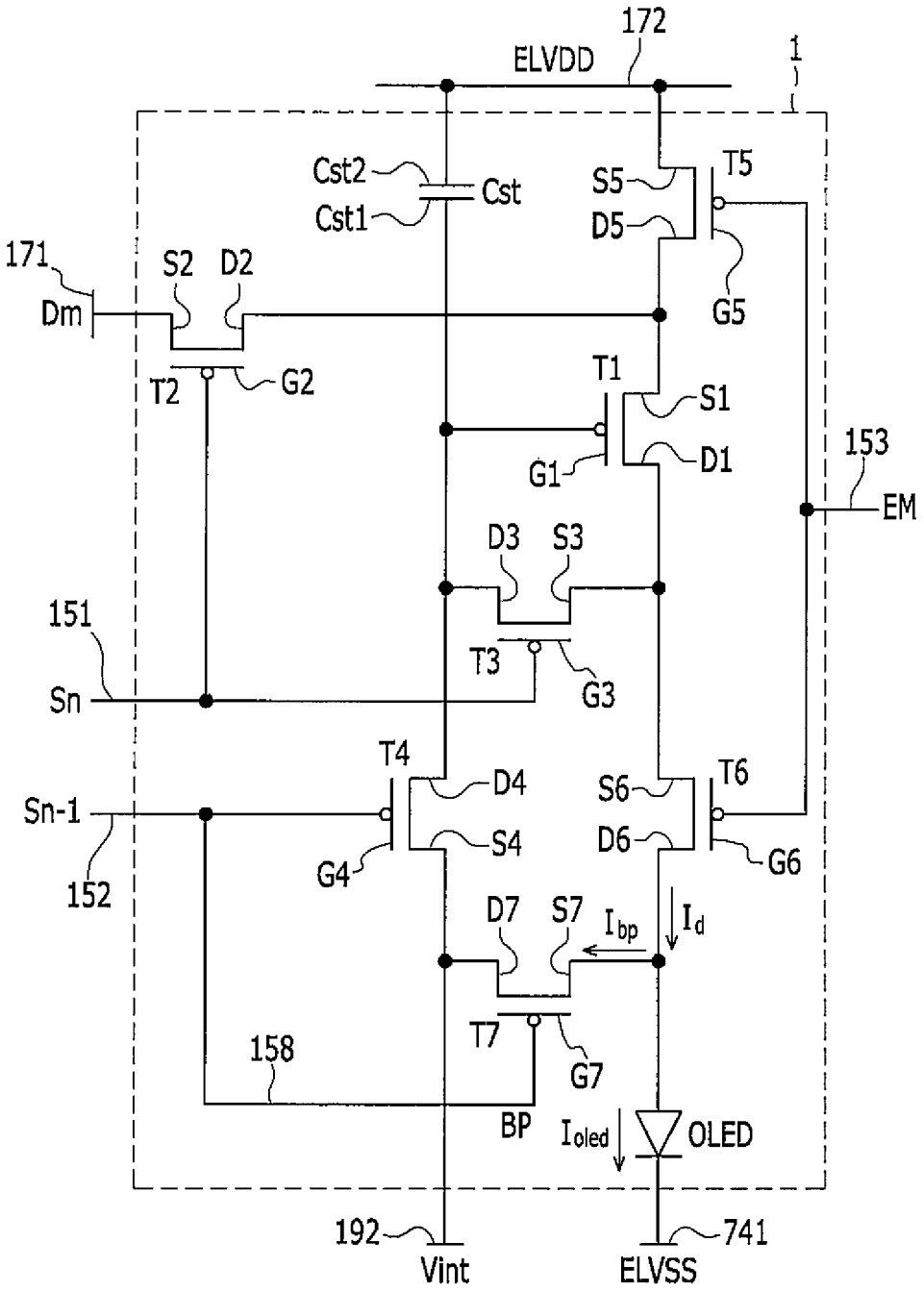
FIG. 1 is an equivalent circuit diagram of one pixel of an organic light emitting diode display according to a first exemplary embodiment of the present invention.

Hereinafter, example embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof may not be repeated.

In the drawings, the relative sizes of elements, layers, and regions may be exaggerated for clarity. Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present invention. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Now, an organic light emitting diode display according to exemplary embodiments of the present invention will be described in more detail with reference to FIGS. 1 to 10.

FIG. 1 is an equivalent circuit diagram of one pixel of an organic light emitting diode display according to a first exemplary embodiment of the present invention.

As illustrated in FIG. 1, a pixel 1 of an organic light emitting diode display according to an exemplary embodiment of the present invention includes a plurality of signal lines 151, 152, 153, 158, 171, 172, and 192, a plurality of transistors T1, T2, T3, T4, T5, T6, and T7, which is connected to the plurality of signal lines, a storage capacitor Cst, and an organic light emitting diode ("OLED").

The transistors T1, T2, T3, T4, T5, T6, and T7 include a driving transistor T1, a switching transistor T2, a compensation transistor T3, an initialization transistor T4, an operation control transistor T5, a light emission control transistor T6, and a bypass transistor T7.

The signal lines 151, 152, 153, 158, 171, 172, and 192 include a scan line 151 for transmitting a scan signal Sn, a previous stage scan line 152 for transmitting a previous stage scan signal Sn−1 to the initialization transistor T4, a light emission control line 153 for transmitting a light emission control signal EM to the operation control transistor T5 and the light emission control transistor T6, a bypass control line 158 for transmitting a bypass signal BP to the bypass transistor T7, a data line 171 crossing the scan line 151 and for transmitting a data signal Dm, a driving voltage line 172 to transmit a driving voltage ELVDD and formed to be parallel to or substantially parallel to the data line 171, and an initialization voltage line 192 for transmitting an initialization voltage Vint which initializes the driving transistor T1.

A gate electrode G1 of the driving transistor T1 is connected to one end Cst1 of the storage capacitor Cst, a source electrode S1 of the driving transistor T1 is connected to the driving voltage line 172 via the operation control transistor T5, and the drain electrode D1 of the driving transistor T1 is electrically connected to an anode of the organic light emitting diode OLED via the light emission control transistor T6. The driving transistor T1 receives the data signal Dm in accordance with a switching operation of the switching transistor T2 to supply a driving current Id to the organic light emitting diode OLED.

A gate electrode G2 of the switching transistor T2 is connected to the scan line 151, a source electrode S2 of the switching transistor T2 is connected to the data line 171, and a drain electrode D2 of the switching transistor T2 is connected to the source electrode S1 of the driving transistor T1 and is also connected to the driving voltage line 172 via the operation control transistor T5. The switching transistor T2 is turned on by the scan signal Sn, which is received through the scan line 151, to perform a switching operation for transmitting the data signal Dm, which is transmitted from the data line 171, to the source electrode S1 of the driving transistor T1.

A gate electrode G3 of the compensation transistor T3 is connected to the scan line 151, a source electrode S3 of the compensation transistor T3 is connected to the drain electrode D1 of the driving transistor T1 and is also connected to the anode of the organic light emitting diode OLED via the light emission control transistor T6, and a drain electrode D3 of the compensation transistor T3 is connected to the drain electrode D4 of the initialization transistor T4, the one end Cst1 of the storage capacitor Cst, and the gate electrode G1 of the driving transistor T1. The compensation transistor T3 is turned on in accordance with the scan signal Sn, which is received through the scan line 151, to connect the gate electrode G1 and the drain electrode D1 of the driving transistor T1 to each other. In other words, the compensation transistor T3 is turned on to connect (e.g., diode-connect) the driving transistor T1 as a diode.

A gate electrode G4 of the initialization transistor T4 is connected to the previous stage scan line 152, a source electrode S4 of the initialization transistor T4 is connected to the initialization voltage line 192, and a drain electrode D4 of the initialization transistor T4 is connected to the one end Cst1 of the storage capacitor Cst, the drain electrode D3 of the compensation transistor T3, and the gate electrode G1 of the driving transistor T1. The initialization transistor T4 is turned on in accordance with the previous stage scan signal Sn−1, which is received through the previous stage scan line 152, to perform an initialization operation for transmitting the initialization voltage Vint to the gate electrode G1 of the driving transistor T1 and to initialize a gate voltage of the gate electrode G1 of the driving transistor T1.

A gate electrode G5 of the operation control transistor T5 is connected to the light emission control line 153, a source electrode S5 of the operation control transistor T5 is connected to the driving voltage line 172, and a drain electrode D5 of the operation control transistor T5 is connected to the source electrode S1 of the driving transistor T1 and the drain electrode D2 of the switching transistor T2.

A gate electrode G6 of the light emission control transistor T6 is connected to the light emission control line 153, a source electrode S6 of the light emission control transistor T6 is connected to the drain electrode D1 of the driving transistor T1 and the source electrode S3 of the compensation transistor T3, and a drain electrode D6 of the light emission control transistor T6 is electrically connected to the anode of the organic light emitting diode OLED. The operation control transistor T5 and the light emission control transistor T6 are concurrently (e.g., simultaneously) turned on in accordance with the light emission control signal EM, which is received through the light emission control line 153, and the driving voltage ELVDD is compensated by the diode-connected driving transistor T1 to be transmitted to the organic light emitting diode OLED.

A gate electrode G7 of the bypass transistor T7 is connected to the bypass control line 158, a source electrode S7 of the bypass transistor T7 is connected to the drain electrode D6 of the light emission control transistor T6 and the anode of the organic light emitting diode OLED, and the drain electrode D7 of the bypass transistor T7 is connected to the initialization voltage line 192 and the source electrode S4 of the initialization transistor T4. Here, since the bypass control line 158 is connected to the previous stage scan line 152, the bypass signal BP is equal to or substantially equal to the previous stage scan signal Sn−1.

The other end Cst2 of the storage capacitor Cst is connected to the driving voltage line 172, and a cathode of the organic light emitting diode OLED is connected to a common voltage line 741, which transmits a common voltage ELVSS.

In the exemplary embodiment of the present invention shown in FIG. 1, even though a structure having seven transistors including the bypass transistor T7 and one capacitor is illustrated, the present invention is not limited thereto, and the number of transistors and the number of capacitors may be modified in various ways.

Hereinafter, an operating process of one pixel of an organic light emitting diode display according to an exemplary embodiment of the present invention will be described in detail with reference to FIG. 2.

Figure 2:
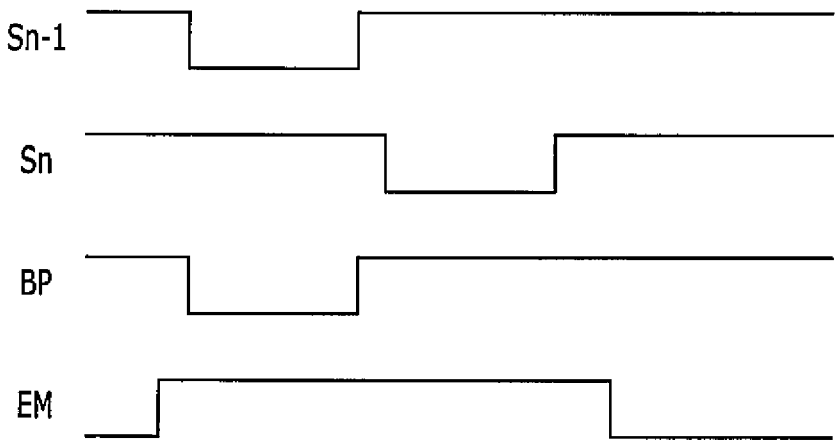
FIG. 2 is a timing chart of signals which are applied to one pixel of an organic light emitting diode display according to a first exemplary embodiment of the present invention.

FIG. 2 is a timing chart of signals which are applied to one pixel of an organic light emitting diode display according to a first exemplary embodiment of the present invention.

As illustrated in FIG. 2, first, during an initialization period, a low level previous stage scan signal Sn−1 is supplied through the previous stage scan line 152. When a low level previous stage scan signal Sn−1 is supplied, the initialization transistor T4 is turned on in response to the low level previous stage scan signal Sn−1, the initialization voltage Vint is connected to the gate electrode G1 of the driving transistor T1 through the initialization transistor T4 from the initialization voltage line 192, and the driving transistor T1 is initialized by the initialization voltage Vint.

Thereafter, during a data programming period, a low level scan signal Sn is supplied through the scan line 151. When the low level scan signal Sn is supplied, the switching transistor T2 and the compensation transistor T3 are turned on corresponding to the low level scan signal Sn. In this case, the driving transistor T1 is diode-connected by the turned-on compensation transistor T3, and is biased in a forward direction.

Thus, a compensated voltage (Dm+Vth, where Vth has a negative value) obtained by subtracting a threshold value Vth of the driving transistor T1 from the data signal Dm supplied from the data line 171 is applied to the gate electrode G1 of the driving transistor T1. The driving voltage ELVDD and the compensated voltage (Dm+Vth) are applied to respective ends Cst2 and Cst1 of the storage capacitor Cst, and a charge corresponding to a voltage difference between the ends is stored in the storage capacitor Cst.

Thereafter, during a light emission period, the light emission control signal EM, which is supplied from the light emission control line 153, is changed from a high level to a low level. When the light emission control signal EM is changed to a low level during the light emission period, the operation control transistor T5 and the light emission control transistor T6 are turned on by the low level light emission control signal EM.

Therefore, a driving current Id generated by the voltage difference between the gate voltage of the gate electrode G1 of the driving transistor T1 and the driving voltage ELVDD is supplied through the light emission control transistor T6 to the organic light emitting diode OLED. During the light emission period, a gate-source voltage Vgs of the driving transistor T1 is maintained or substantially maintained by the storage capacitor Cst to equal or substantially equal (Dm+Vth)−ELVDD. Thus, according to the current-voltage relationship of the driving transistor T1, the driving current Id is proportional to a square $(Dm-ELVDD)^2$ of a value obtained by subtracting the threshold value Vth from the source-gate voltage. Therefore, the driving current Id is determined regardless of the threshold value Vth of the driving transistor T1.

In this case, the bypass transistor T7 receives the bypass signal BP from the bypass control line 158. The bypass signal BP is a level (e.g., a predetermined level) of voltage which turns off the bypass transistor T7. The bypass transistor T7 receives a transistor-off level voltage at the gate electrode G7, so that the bypass transistor T7 is turned off, and a portion of the driving current Id bypasses through the bypass transistor T7 as a bypass current Ibp when the bypass transistor T7 is in an off-state.

Even when a minimum current of the driving transistor T1 which displays a black image flows as a driving current, if the organic light emitting diode OLED emits light, the black image is not correctly displayed. Accordingly, the bypass transistor T7 of the organic light emitting diode display according to the present exemplary embodiment may distribute a portion of the minimum current of the driving transistor T1 in a current path other than the current path of the organic light emitting diode as the bypass current Ibp. Here, the minimum current of the driving transistor T1 refers to a current corresponding to when the gate-source voltage Vgs of the driving transistor T1 is lower than the threshold voltage Vth, so that the driving transistor T1 is turned off. As described above, the minimum driving current (for example, a current which is equal to or lower than 10 pA) corresponding to when the driving transistor T1 is turned off is transmitted to the organic light emitting diode OLED and represents an image having a black luminance. When the minimum driving current at which the black image is displayed flows, bypass of the bypass current Ibp is significantly affected, but when a high driving current at which an image such as a general image or a white image is displayed flows, bypass current Ibp is hardly (e.g., minimally or not significantly) affected. Therefore, when the driving current at which the black image is displayed flows, an emission current Ioled of the organic light emitting diode OLED, which is reduced from the driving current Id by a current amount of the bypass current Ibp bypassing through the bypass transistor T7, has the minimum current amount so as to reliably display the black image. Therefore, correct black luminance image is represented by using the bypass transistor T7, thereby improving a contrast ratio. In FIG. 2, the bypass signal BP is equal to or substantially equal to the previous stage scan signal Sn−1, but is not limited thereto.

Hereinafter, a detailed structure of the organic light emitting diode display according to some exemplary embodiments of the present invention to which the above structure may be applied will be described in detail with reference to FIGS. 3 to 10.

Figure 3:
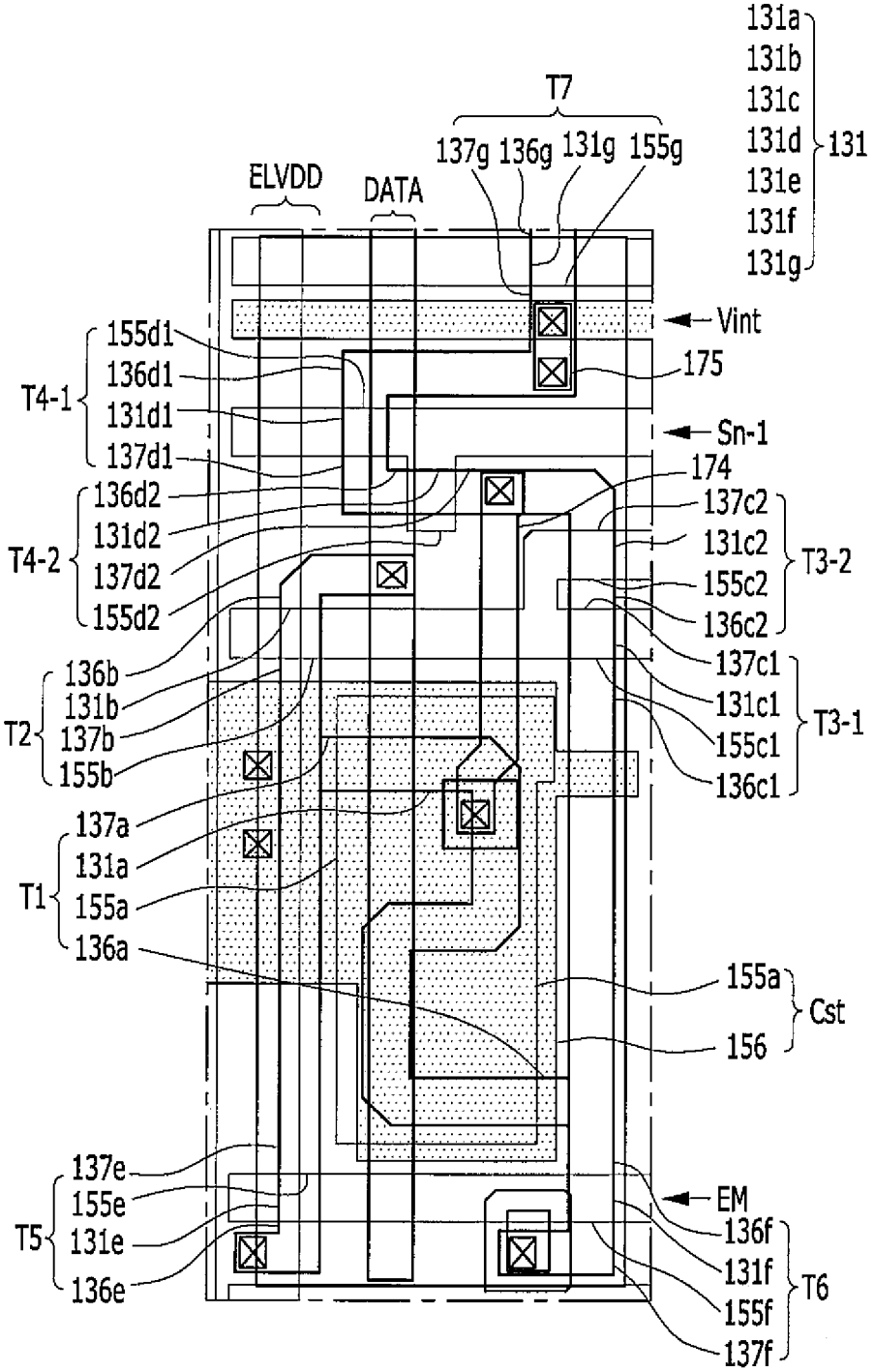
FIG. 3 is a view schematically illustrating a plurality of transistors and a capacitor of an organic light emitting diode display according to a first exemplary embodiment of the present invention.

FIG. 3 is a view schematically illustrating a plurality of transistors and a capacitor of an organic light emitting diode display according to a first exemplary embodiment of the present invention.

As illustrated in FIGS. 1 and 3, an organic light emitting diode display according to an exemplary embodiment of the present invention includes the scan line 151, the previous stage scan line 152, the light emission control line 153, and the bypass control line 158, which apply the scan signal Sn, the previous stage scan signal Sn−1, the light emission control signal EM, and the bypass signal BP, respectively, and are formed along a row direction. Further, the organic light emitting diode display includes the data line 171 and the driving voltage line 172 which cross the scan line 151, the previous stage scan line 152, the light emission control line 153, and the bypass control line 158, and apply the data signal Dm and the driving voltage ELVDD, respectively, to the pixel 1. The initialization voltage Vint is transmitted from the initialization voltage line 192 to the compensation transistor T3 via the initialization transistor T4.

Further, in the pixel 1, the driving transistor T1, the switching transistor T2, the compensation transistor T3, the initialization transistor T4, the operation control transistor T5, the light emission control transistor T6, the bypass transistor T7, the storage capacitor Cst, and the organic light emitting diode OLED are formed. The organic light emitting diode OLED is formed of a pixel electrode, an organic emission layer, and a common electrode. In this case, in the organic light emitting diode display according to the first exemplary embodiment of the present invention, the compensation transistor T3 and the initialization transistor T4 are configured as a dual gate structure transistor in order to block the leakage current.

A channel of each of the driving transistor T1, the switching transistor T2, the compensation transistor T3, the initialization transistor T4, the operation control transistor T5, the light emission control transistor T6, and the bypass transistor T7 is formed in one connected semiconductor, and the semiconductor may be formed to be curved in various shapes. The semiconductor may be formed of a polysilicon semiconductor material or an oxide semiconductor material. The oxide semiconductor material may include any one of oxide having titanium (Ti), hafnium (Hf), zirconium (Zr), aluminum (Al), tantalum (Ta), germanium (Ge), zinc (Zn), gallium (Ga), tin (Sn), and indium (In) as a base material, and indium-gallium-zinc oxide (InGaZnO4), indium-zinc oxide (Zn—In—O), zinc-tin oxide (Zn—Sn—O) indium-gallium oxide (In—Ga—O), indium-tin oxide (In—Sn—O), indium-zirconium oxide (In—Zr—O), indium-zirconium-zinc oxide (In—Zr—Zn—O), indium-zirconium-tin oxide (In—Zr—Sn—O), indium-zirconium-gallium oxide (In—Zr—Ga—O), indium-aluminum oxide (In—Al—O), indium-zinc-aluminum oxide (In—Zn—Al—O), indium-tin-aluminum oxide (In—Sn—Al—O), indium-aluminum-gallium oxide (In—Al—Ga—O), indium-tantalum oxide (In—Ta—O), indium-tantalum-zinc oxide (In—Ta—Zn—O), indium-tantalum-tin oxide (In—Ta—Sn—O), indium-tantalum-gallium oxide (In—Ta—Ga—O), indium-germanium oxide (In—Ge—O), indium-germanium-zinc oxide (In—Ge—Zn—O), indium-germanium-tin oxide (In—Ge—Sn—O), indium-germanium-gallium oxide (In—Ge—Ga—O), titanium-indium-zinc oxide (Ti—In—Zn—O), hafnium-indium-zinc oxide Hf—In—Zn—O), which are composite oxides thereof. When the semiconductor is formed of the oxide semiconductor material, a passivation layer may be added in order to protect the oxide semiconductor material, which may be vulnerable to an external environment such as a high temperature.

The semiconductor includes a channel which is doped with a N-type impurity or a P-type impurity and a source doping unit and a drain doping unit which are formed at both sides of the channel and are doped with more impurities than the impurity which is doped in the channel. In the present exemplary embodiment, the source doping unit and the drain doping unit correspond to the source electrode and the drain electrode, respectively. The source electrode and the drain electrode formed in the semiconductor may be formed by doping the impurity only in a corresponding region. Further, in the semiconductor, a region between the source electrode and the drain electrode of different transistors is doped so that the source electrode and the drain electrode may be electrically connected to each other.

As illustrated in FIG. 3, a channel 131 includes a driving channel 131*a* formed in the driving transistor T1, a switching channel 131*b* formed in the switching transistor T2, a compensation channel 131*c* formed in the compensation transistor T3, an initialization channel 131*d* formed in the initialization transistor T4, an operation control channel 131*e* formed in the operation control transistor T5, a light emission control channel 131*f* formed in the light emission control transistor T6, and a bypass channel 131*g* formed in the bypass transistor T7.

The driving transistor T1 includes the driving channel 131*a*, a driving gate electrode 155*a*, a driving source electrode 136*a*, and a driving drain electrode 137*a*. The driving channel 131*a* is curved and may have a meandering shape or a zigzag shape. As described above, a curved driving channel 131*a* is formed, so that the long driving channel 131*a* may be formed in a narrow space. Accordingly, a driving range of the gate voltage Vg, which is applied to the driving gate electrode 155*a*, is broadened by the long driving channel 131*a*. Since the driving range of the gate voltage Vg is large, a gray level of light emitted from the organic light emitting diode OLED may be more precisely controlled by changing a magnitude of the gate voltage Vg, and as a result, a resolution of the organic light emitting diode display may be increased and a display quality may be improved. However, the present invention is not limited thereto, and the shape of the driving channel 131*a* may be modified to have various suitable shapes, such as an 'inverse S', 'S', 'M', or 'W,' so that various exemplary embodiments may be implemented.

The driving gate electrode 155*a* overlaps the driving channel 131*a*, and the driving source electrode 136*a* and the driving drain electrode 137*a* are formed to be adjacent to respective sides of the driving channel 131*a*. The driving gate electrode 155*a* is connected to the first data connecting member 174 through a contact hole.

The switching transistor T2 includes the switching channel 131*b*, a switching gate electrode 155*b*, a switching source electrode 136*b*, and a switching drain electrode 137*b*. The switching gate electrode 155*b* is a portion of the scan line 151 overlapping the switching channel 131*b*, and the switching source electrode 136*b* and the switching drain electrode 137*b* are formed to be adjacent to respective sides of the switching channel 131*b*. The switching source electrode 136*b* is connected to the data line 171 through a contact hole.

Two compensation transistors T3 are formed in order to prevent or substantially prevent the leakage current, and include a first compensation transistor T3-1 and a second compensation transistor T3-2, which are adjacent to each other. The first compensation transistor T3-1 is located with respect to the scan line 151 and the second compensation transistor T3-2 is located with respect to a protrusion of the scan line 151. The first compensation transistor T3-1 includes a first compensation channel 131*c*1, a first compensation gate electrode 155*c*1, a first compensation source electrode 136*c*1, and a first compensation drain electrode 137*c*1, and the second compensation transistor T3-2 includes a second compensation channel 131*c*2, a second compensation gate electrode 155*c*2, a second compensation source electrode 136*c*2, and a second compensation drain electrode 137*c*2.

The first compensation gate electrode 155*c*1, which is a portion of the scan line 151, overlaps the first compensation channel 131*c*1, and the first compensation source electrode 136*c*1 and the first compensation drain electrode 137*c*1 are formed to be adjacent to respective sides of the first compensation channel 131*c*1. The first compensation source electrode 136*c*1 is connected to the light emission control source electrode 136*f*, and the first compensation drain electrode 137*c*1 is connected to the second compensation source electrode 136*c*2.

The second compensation gate electrode 155*c*2, which is a protrusion upwardly protruding from the scan line 151, overlaps the second compensation channel 131*c*2, and the second compensation source electrode 136*c*2 and the second compensation drain electrode 137*c*2 are formed to be adjacent to respective sides of the second compensation channel 131*c*2. The second compensation drain electrode 137*c*2 is connected to the first data connecting member 174 through a contact hole.

A plurality of initialization transistors T4 is formed to prevent or substantially prevent the leakage current, and includes a first initialization transistor T4-1 and a second initialization transistor T4-2 which are adjacent to each other. The first initialization transistor T4-1 is located with respect to the previous stage scan line 152, and the second initialization transistor T4-2 is located with respect to a protrusion of the previous stage scan line 152. The first initialization transistor T4-1 includes a first initialization channel 131*d*1, a first initialization gate electrode 155*d*1, a first initialization source electrode 136*d*1, and a first initialization drain electrode 137*d*1, and the second initialization transistor T4-2 includes a second initialization channel 131*d*2, a second initialization gate electrode 155*d*2, a second initialization source electrode 136*d*2, and a second initialization drain electrode 137*d*2.

The first initialization gate electrode 155*d*1, which is a portion of the previous stage scan line 152, overlaps the first initialization channel 131*d*1, and the first initialization source electrode 136*d*1 and the first initialization drain electrode 137*d*1 are formed to be adjacent to respective sides of the first initialization channel 131*d*1. The first initialization source electrode 136*d*1 is connected to a second data connecting member 175 through a contact hole, and the first initialization drain electrode 137*d*1 is connected to the second initialization source electrode 136*d*2.

The second initialization gate electrode 155*d*2, which is a protrusion downwardly protruding from the previous stage scan line 152, overlaps the second initialization channel 131*d*2, and the second initialization source electrode 136*d*2 and the second initialization drain electrode 137*d*2 are formed to be adjacent to respective sides of the second initialization channel 131*d*2. The second initialization drain electrode 137*d*2 is connected to the first data connecting member 174 through a contact hole.

As described above, the compensation transistors T3 are formed by two compensation transistors including the first compensation transistor T3-1 and the second compensation transistor T3-2, and the initialization transistors T4 are formed by two initialization transistors including the first initialization transistor T4-1 and the second initialization transistor T4-2, thereby efficiently preventing or substantially preventing the current from being generated.

The operation control transistor T5 includes an operation control channel 131*e*, an operation control gate electrode 155*e*, an operation control source electrode 136*e*, and an operation control drain electrode 137*e*. The operation control gate electrode 155*e*, which is a portion of the light emission control line 153, overlaps the operation control channel 131*e*, and the operation control source electrode 136*e* and the operation control drain electrode 137*e* are formed to be adjacent to respective sides of the operation control channel 131*e*. The operation control source electrode 136*e* is connected to a portion of the driving voltage line 172 through a contact hole.

The light emission control transistor T6 includes a light emission control channel 131*f*, a light emission control gate electrode 155*f*, a light emission control source electrode 136*f*, and a light emission control drain electrode 137*f*. The light emission control gate electrode 155*f*, which is a portion of the light emission control line 153, overlaps the light emission control channel 131*f*, and the light emission control source electrode 136*f* and the light emission control drain electrode 137*f* are formed to be adjacent to respective sides of the light emission control channel 131*f*.

The bypass transistor T7 includes a bypass channel 131*g*, a bypass gate electrode 155*g*, a bypass source electrode 136*g*, and a bypass drain electrode 137*g*. The bypass gate electrode 155*g*, which is a portion of the bypass control line 158, overlaps the bypass channel 131*g*, and the bypass source electrode 136*g* and the bypass drain electrode 137*g* are formed to be adjacent to respective sides of the bypass channel 131*g*.

One end of the driving channel 131*a* of the driving transistor T1 is connected to the switching drain electrode 137*b* and the operation control drain electrode 137*e*, and the other end of the driving channel 131*a* is connected to the compensation source electrode 136*c* and the light emission control source electrode 136*f*.

The storage capacitor Cst includes a first storage electrode 155*a* and a second storage electrode 156 with a second insulating layer 142 therebetween. The first storage electrode 155*a* corresponds to the driving gate electrode 155*a*, and the second storage electrode 156 is a portion extending from the storage line. The second storage electrode 156 occupies an area wider than that of the driving gate electrode 155*a* and substantially covers the entire driving gate electrode 155*a*. Here, the second insulating layer 142 includes a dielectric material, and a storage capacitance is determined by the charge stored in the storage capacitor Cst and a voltage between both electrodes 155*a* and 156. As described above, the driving gate electrode 155*a* is used as the first storage electrode 155*a*, so that a space for forming the storage capacitor may be secured in a space which is narrowed by the driving channel 131*a* which occupies the large area in the pixel.

Figure 4:
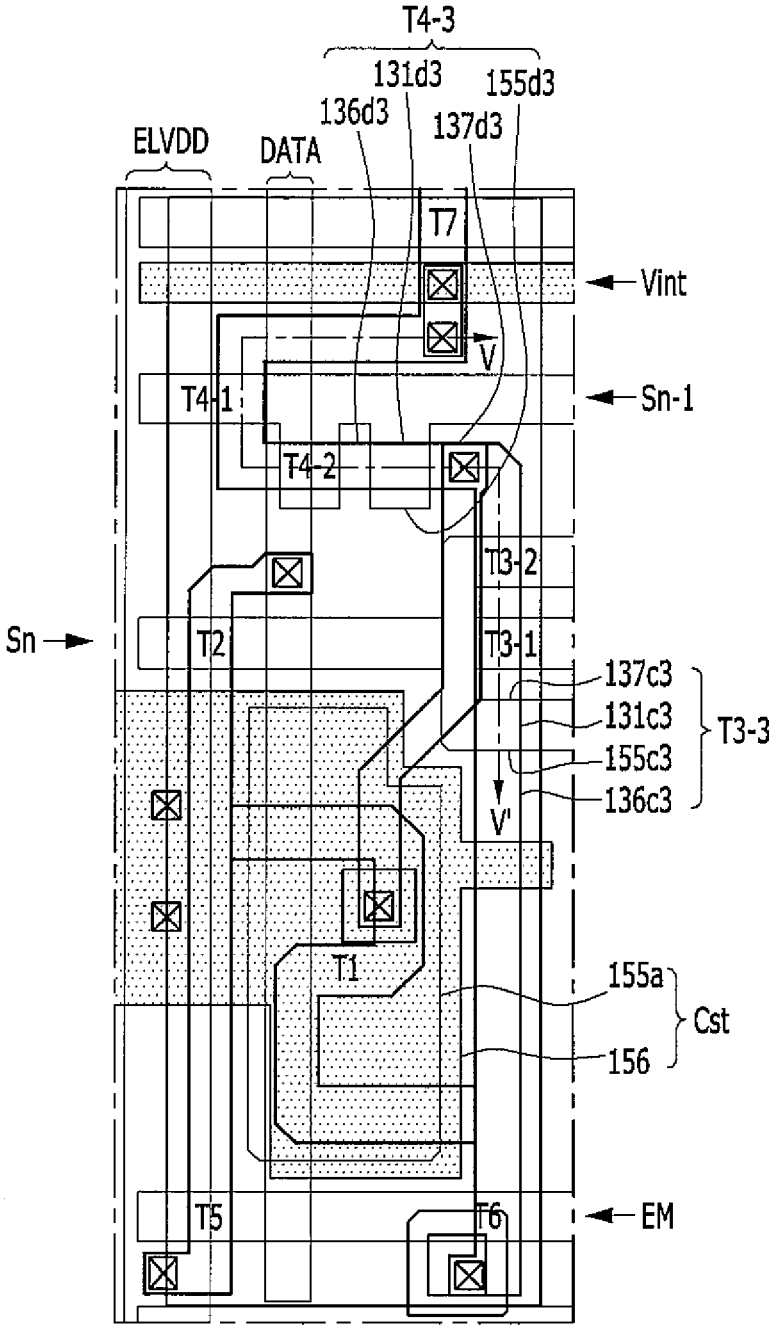
FIG. 4 is a view schematically illustrating a plurality of transistors and a capacitor of an organic light emitting diode display according to a second exemplary embodiment of the present invention.

FIG. 4 is a view schematically illustrating a plurality of transistors and a capacitor of an organic light emitting diode display according to a second exemplary embodiment of the present invention.

Referring to FIG. 4, an organic light emitting diode display according to a second exemplary embodiment of the present invention further includes a third compensation transistor T3-3 and a third initialization transistor T4-3.

Here, three compensation transistors T3 are formed to prevent or substantially prevent the leakage current, and includes the first compensation transistor T3-1, the second compensation transistor T3-2, and the third compensation transistor T3-3, which are adjacent to each other. The first compensation transistor T3-1 and the second compensation transistor T3-2 have been described with reference to FIG. 3, and thus, detailed description may be omitted.

The first compensation transistor T3-1 is located with respect to the scan line 151, the second compensation transistor T3-2 is located with respect to an upper protrusion of the scan line 151, and the third compensation transistor T3-3 is located with reference to a lower protrusion of the scan line 151.

The third compensation transistor T3-3 includes a third compensation channel 131*c*3, a third compensation gate electrode 155*c*3, a third compensation source electrode 136*c*3, and a third compensation drain electrode 137*c*3.

The third compensation gate electrode 155*c*3, which is a portion downwardly protruding from the scan line 151, overlaps the third compensation channel 131*c*3, and the third compensation source electrode 136*c*3 and third compensation drain electrode 137*c*3 are formed to be adjacent to respective sides of the third compensation channel 131*c*3. Further, the third compensation drain electrode 137*c*3 is connected to the first compensation gate electrode 155*c*1, which is a portion of the scan line 151.

Further, three initialization transistors T4 are formed to prevent or substantially prevent the leakage current, and includes a first initialization transistor T4-1, a second initialization transistor T4-2, and a third initialization transistor T4-3, which are adjacent to each other. Here, the first initialization transistor T4-1 and the second initialization transistor T4-2 have been described with reference to FIG. 3, and thus, detailed description may be omitted.

The third initialization transistor T4-3 is located with reference to the protrusion of the previous stage scan line 152, similarly to the second initialization transistor T4-2.

The third initialization transistor T4-3 includes a third initialization channel 131*d*3, a third initialization gate electrode 155*d*3, a third initialization source electrode 136*d*3, and a third initialization drain electrode 137*d*3.

Hereinafter, a cross-sectional structure of an organic light emitting diode display according to an exemplary embodiment of the present invention will be described in order of lamination, with reference to FIGS. 5 and 6.

Figure 5:
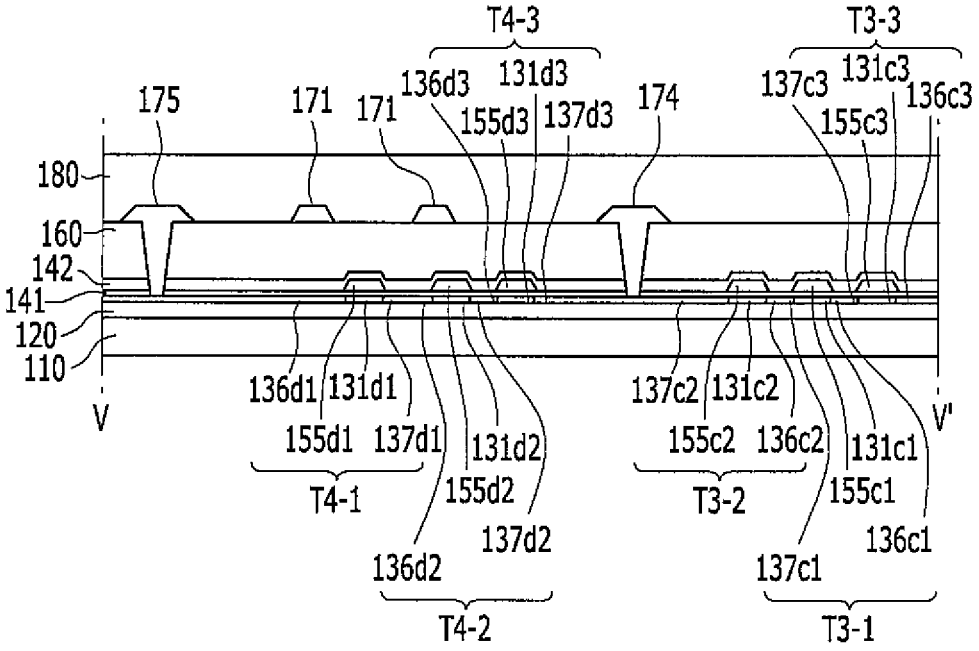
FIG. 5 is a cross-sectional view taken along the line V-V' of the organic light emitting diode display of FIG. 4.
Figure 6:
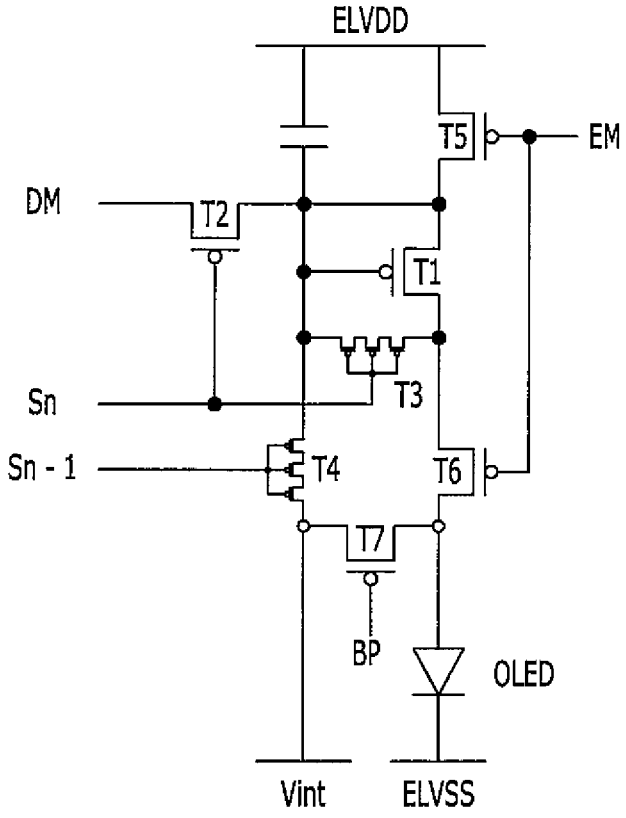
FIG. 6 is an equivalent circuit diagram of one pixel of an organic light emitting diode display of FIG. 4.

FIG. 5 is a cross-sectional view taken along the line V-V' of the organic light emitting diode display of FIG. 4, and FIG. 6 is an equivalent circuit diagram of a pixel of an organic light emitting diode display of FIG. 4.

As illustrated in FIGS. 5 and 6, a compensation transistor T3 and an initialization transistor T4 of the organic light emitting diode display according to an exemplary embodiment of the present invention are configured as a transistor having a plurality of gate structures in order to block the leakage current.

A buffer layer 120 is formed on a substrate 110. The substrate 110 may be formed of an insulating substrate, which is formed of glass, quartz, ceramic, or plastic, and the buffer layer 120 serves to block an impurity from the substrate 110 during a crystallizing process for forming a polysilicon semiconductor, thereby improving a characteristic of the polysilicon semiconductor and reducing stress which is applied to the substrate 110.

A semiconductor including a driving channel 131*a*, a switching channel 131*b*, a compensation channel 131*c*, an initialization channel 131*d*, an operation control channel 131*e*, a light emission control channel 131*f*, and a bypass channel 131*g* is formed on the buffer layer 120. In the semiconductor, a driving source electrode 136*a* and a driving drain electrode 137*a* are formed at respective sides of the driving channel 131*a*, and a switching source electrode 136*b* and a switching drain electrode 137*b* are formed at respective sides of the switching channel 131*b*. Further, a first compensation source electrode 136*c*1 and a first compensation drain electrode 137*c*1 are formed at respective sides of the first compensation channel 131*c*1, a second compensation source electrode 136*c*2 and a second compensation drain electrode 137*c*2 are formed at respective sides of the second compensation channel 131*c*2, a first initialization source electrode 136*d*1 and a first initialization drain electrode 137*d*1 are formed at respective sides of the first initialization channel 131*d*1, and a second initialization source electrode 136*d*2 and a second initialization drain electrode 137*d*2 are formed at respective sides of the second initialization channel 131*d*2. Furthermore, an operation control source electrode 136*e* and an operation control drain electrode 137*e* are formed at respective sides of the operation control channel 131*e*, and a light emission control source electrode 136*f* and a light emission control drain electrode 137*f* are formed at respective sides of the light emission control channel 131*f*. A bypass source electrode 136*g* and a bypass drain electrode 137*g* are formed at respective sides of the bypass channel 131*g*.

Further, a third compensation source electrode 136*c*3 and a third compensation drain electrode 137*c*3 are formed at respective sides of the third compensation channel 131*c*3, and the third initialization source electrode 136*d*3 and the third initialization drain electrode 137*d*3 are formed at respective sides the third initialization channel 131*d*3.

A first gate insulating layer 141 is formed on the semiconductor to cover the semiconductor. A first gate wire which includes the previous stage scan line 152 including the first initialization gate electrode 155*d*1, the second initialization gate electrode 155*d*2, and the third initialization gate electrode 155*d*3, and a scan line 151 including the first compensation gate electrode 155*c*1, the second compensation gate electrode 155*c*2, and the third compensation gate electrode 155*c*3 are formed on the first gate insulating layer 141.

A second gate insulating layer 142 is formed on the first gate wire and the first gate insulating layer 141 to cover the first gate wire and the first gate insulating layer 141. The first gate insulating layer 141 and the second gate insulating layer 142 may be formed of silicon nitride (SiNx) or silicon oxide $SiO_2$.

A storage line which is disposed to be parallel to the scan line 151, and a second gate wire including a second storage electrode 156 which extends from the storage line may be formed on the second gate insulating layer 142.

An interlayer insulating layer 160 is formed on the second gate insulating layer 142. The interlayer insulating layer 160 may be formed of silicon nitride (SiNx) or silicon oxide $SiO_2$.

A contact hole is formed in the interlayer insulating layer 160. Data wires 171, 172, 174, and 175 including the data line 171, the driving voltage line 172, the first data connecting member 174, and the second data connecting member 175 are formed on the interlayer insulating layer 160.

Further, a passivation layer 180 is formed on the data wires 171, 172, 174, and 175 and the interlayer insulating layer 160 to cover the data wires and the interlayer insulating layer. The passivation layer 180 may be formed of an organic layer.

As described above, three compensation transistors T3 including the first compensation transistor T3-1, the second compensation transistor T3-2, and the third compensation transistor T3-3 are formed, and three initialization transistors T4 including the first initialization transistor T4-1, the second initialization transistor T4-2, and the third initialization transistor T4-3 are formed to minimize or reduce the leakage current, thereby providing an environment where low frequency driving may be performed.

Figure 7:
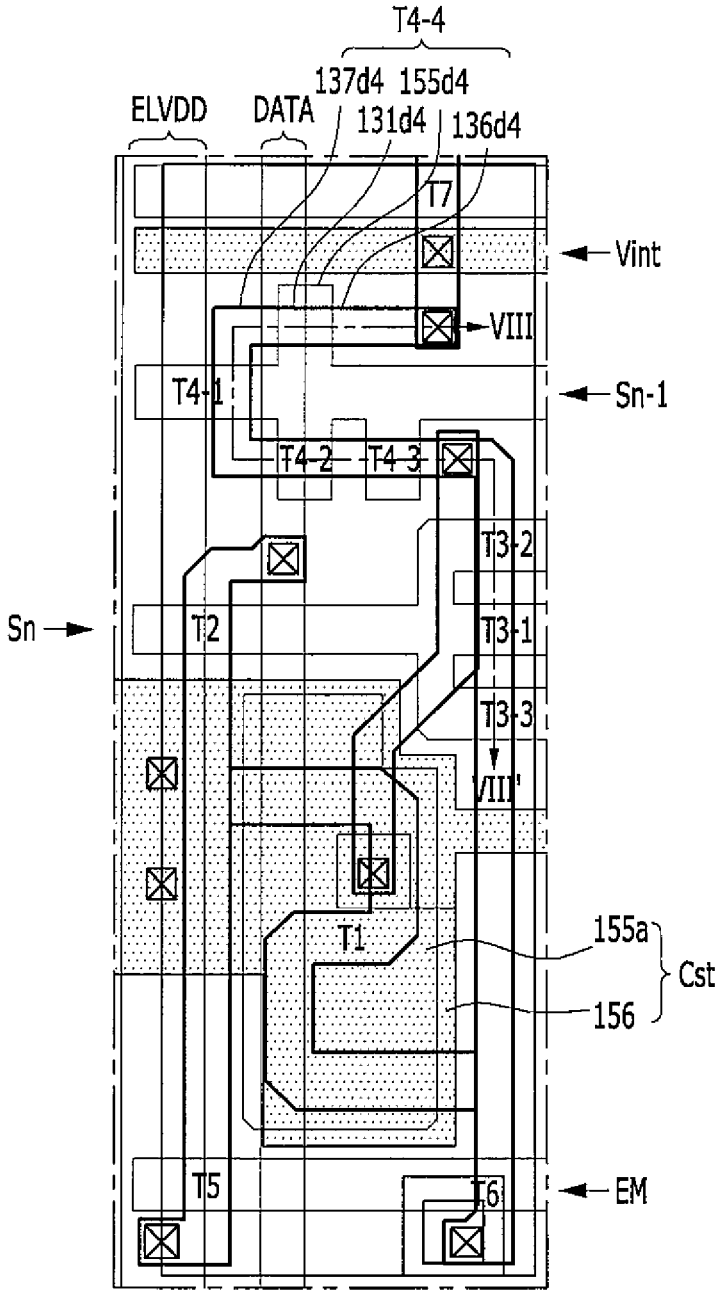
FIG. 7 is a view schematically illustrating a plurality of transistors and a capacitor of an organic light emitting diode display according to a third exemplary embodiment of the present invention.
Figure 8:
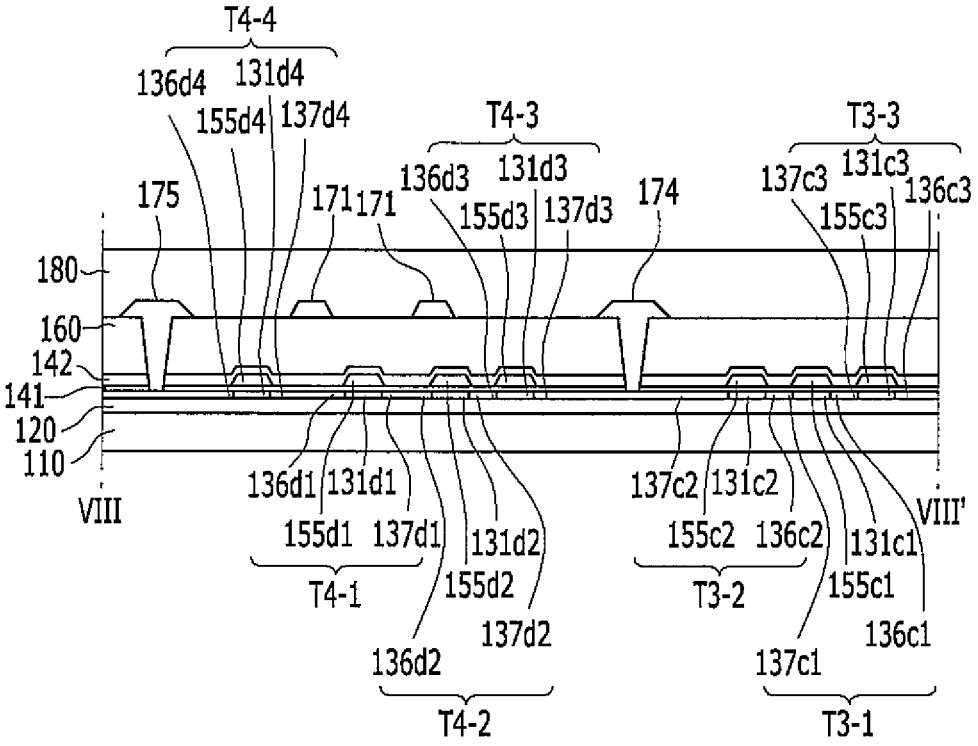
FIG. 8 is a cross-sectional view taken along the line VIII-VIII' of the organic light emitting diode display of FIG. 7.

FIG. 7 is a view schematically illustrating a plurality of transistors and a capacitor of an organic light emitting diode display according to a third exemplary embodiment of the present invention. FIG. 8 is a cross-sectional view taken along the line VIII-VIII' of the organic light emitting diode display of FIG. 7.

Referring to FIGS. 7 and 8, an organic light emitting diode display according to a third exemplary embodiment of the present invention further includes a fourth initialization transistor T4-4.

A plurality of initialization transistors T4 is formed to minimize or reduce the leakage current, and includes a first initialization transistor T4-1, a second initialization transistor T4-2, a third initialization transistor T4-3, and a fourth initialization transistor T4-4, which are adjacent to each other.

The fourth initialization transistor T4-4 is located with respect to the upper protrusion of the previous stage scan line 152. The fourth initialization transistor T4-4 is formed on the same layers as the first compensation transistor T3-1, the second compensation transistor T3-2, the third compensation transistor T3-3, the first initialization transistor T4-1, the second initialization transistor T4-2, and the third initialization transistor T4-3.

The fourth initialization transistor T4-4 includes a fourth initialization channel 131*d*4, a fourth initialization gate electrode 155*d*4, a fourth initialization source electrode 136*d*4, and a fourth initialization drain electrode 137*d*4.

The fourth initialization channel 131*d*4 is formed on the buffer layer 120, and the fourth initialization source electrode 136*d*4 and the fourth initialization drain electrode 137*d*4 are formed at respective sides of the fourth initialization channel 131*d*4.

A first gate insulating layer 141 is formed on the fourth initialization channel 131*d*4, the fourth initialization source electrode 136*d*4, and the fourth initialization drain electrode 137*d*4 to cover the electrodes. A first gate wire including the fourth initialization gate electrode 155*d*4 is formed on the first gate insulating layer 141.

Figure 9:
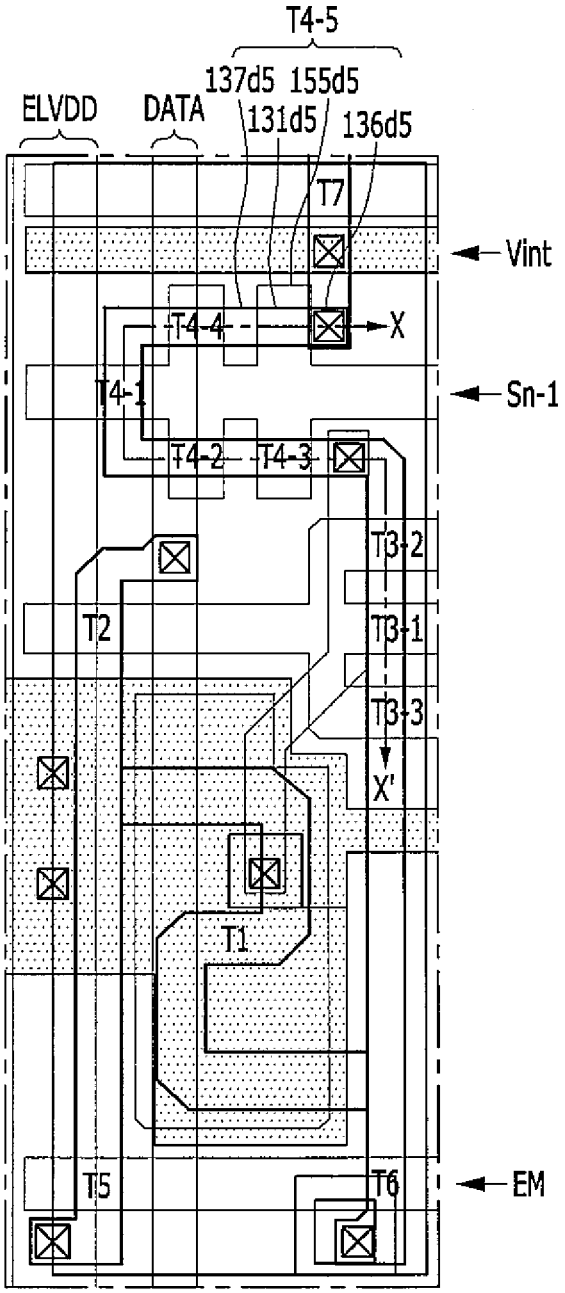
FIG. 9 is a view schematically illustrating a plurality of transistors and a capacitor of an organic light emitting diode display according to a fourth exemplary embodiment of the present invention.
Figure 10:
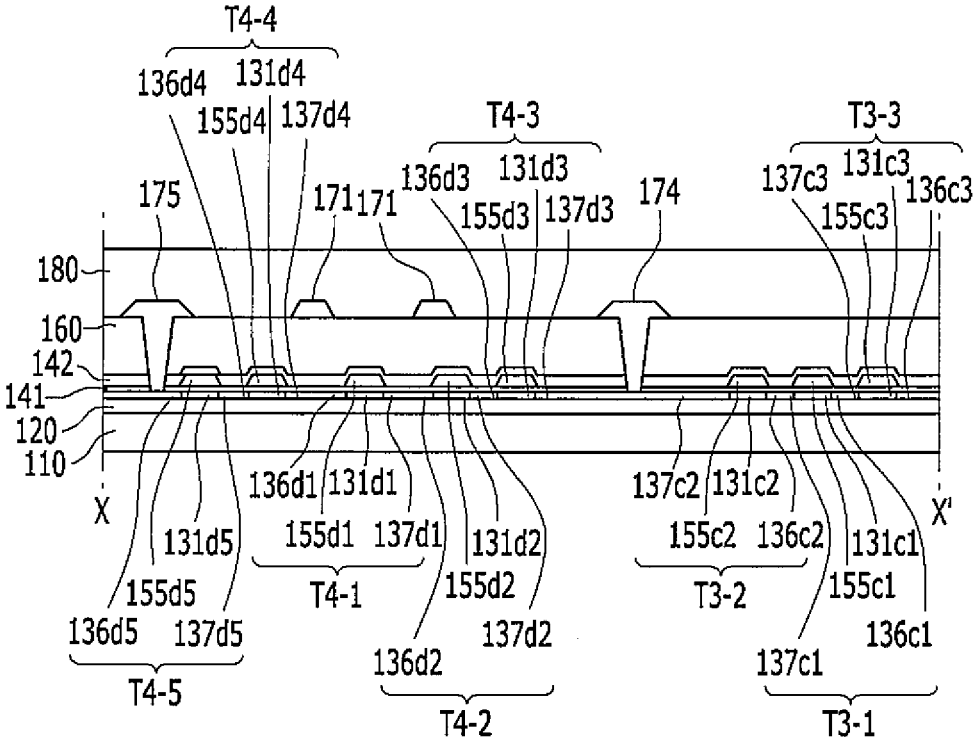
FIG. 10 is a cross-sectional view taken along the line X-X' of the organic light emitting diode display of FIG. 9.

FIG. 9 is a view schematically illustrating a plurality of transistors and a capacitor of an organic light emitting diode display according to a fourth exemplary embodiment of the present invention. FIG. 10 is a cross-sectional view taken along the line X-X' of the organic light emitting diode display of FIG. 9.

Referring to FIGS. 9 and 10, an organic light emitting diode display according to a fourth exemplary embodiment of the present invention further includes a fifth initialization transistor T4-5.

A plurality of initialization transistors T4 is formed to minimize or reduce the leakage current, and includes a first initialization transistor T4-1, a second initialization transistor T4-2, a third initialization transistor T4-3, a fourth initialization transistor T4-4, and a fifth initialization transistor T4-5, which are adjacent to each other.

The fifth initialization transistor T4-5 is formed on the same layers as the first compensation transistor T3-1, the second compensation transistor T3-2, the third compensation transistor T3-3, the first initialization transistor T4-1, the second initialization transistor T4-2, the third initialization transistor T4-3, and the fourth initialization transistor T4-4.

Similarly to the fourth initialization transistor T4-4, the fifth initialization transistor T4-5 is located with respect to the upper protrusion of the previous stage scan line 152. The fifth initialization transistor T4-5 includes a fifth initialization channel 131*d*5, a fifth initialization gate electrode 155*d*5, a fifth initialization source electrode 136*d*5, and a fifth initialization drain electrode 137*d*5.

The fifth initialization channel 131*d*5 is formed on the buffer layer 120, and the fifth initialization source electrode 136*d*5 and the fifth initialization drain electrode 137*d*5 are formed at respective sides of the fifth initialization channel 131*d*5.

A first gate insulating layer 141 is formed on the fifth initialization channel 131*d*5, the fifth initialization source electrode 136*d*5, and the fifth initialization drain electrode 137*d*5 to cover the electrodes. A first gate wire including the fifth initialization gate electrode 155*d*5 is formed on the first gate insulating layer 141.

The organic light emitting diode display according to some exemplary embodiments of the present invention applies different multi-serial gate transistors for every panel position, thereby minimizing or reducing the leakage current of the transistor and reducing the power consumption through low frequency driving.

In the organic light emitting diode display according to some exemplary embodiments of the present invention, the number of serial gates of the compensation transistor T3 and the initialization transistor T4 is differentially changed in consideration of an IR drop of the initialization wire to configure the pixel circuit.

For example, a plurality of pixels of the organic light emitting diode display according to some exemplary embodiments of the present invention includes a first pixel including the initialization transistor T4 having two initialization gate electrodes and the compensation transistor T3 having two compensation gate electrodes, a second pixel including the initialization transistor T4 having three initialization gate electrodes and the compensation transistor T3 having two compensation gate electrode, and a third pixel including the initialization transistor T4 having three initialization gate electrodes and the compensation transistor T3 having three compensation gate electrodes.

Further, a plurality of pixels may further include a fourth pixel including the initialization transistor T4 having four initialization gate electrodes and the compensation transistor T3 having three compensation gate electrodes, and a fifth pixel including the initialization transistor T4 having five initialization gate electrodes and the compensation transistor T3 having three compensation gate electrodes.

Further, in the plurality of pixels, the first pixel to the fifth pixel may be disposed for every substrate position in consideration of a voltage drop of an initialization voltage.

Figure 11:
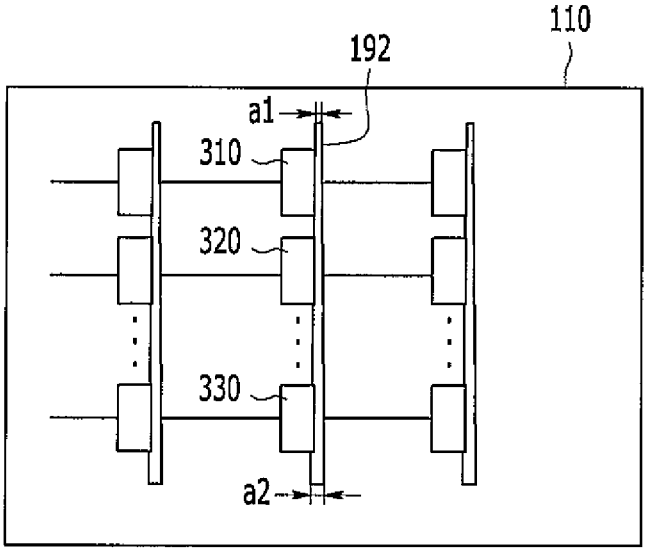
FIG. 11 is a view illustrating a relationship of a thickness of an initializing voltage line in accordance with a number of gate electrodes in an organic light emitting diode display according to an exemplary embodiment of the present invention.

FIG. 11 is a view illustrating a thickness of an initializing voltage line in accordance with the number of gate electrodes in an organic light emitting diode display according to an exemplary embodiment of the present invention.

Referring to FIG. 11, the organic light emitting diode display according to some exemplary embodiments of the present invention includes a first pixel 310 including the initialization transistor T4 having two initialization gate electrodes and the compensation transistor T3 having two compensation gate electrodes, a second pixel 320 including the initialization transistor T4 having three initialization gate electrodes and the compensation transistor T3 having two compensation gate electrode, and a fourth pixel 330 including the initialization transistor T4 having four initialization gate electrodes and the compensation transistor T3 having three compensation gate electrodes.

Further, the pixels 310, 320, and 330 are disposed for every substrate 110 position in consideration of the voltage drop of the initialization voltage, and are connected to the initialization voltage line 192. In the organic light emitting diode display according to some exemplary embodiments of the present invention, widths a1 and a2 of the initialization voltage line 192 may vary (e.g., be different from each other) depending on the number of gate electrodes formed in each pixel 310, 320, and 330.

In the organic light emitting diode display according to some exemplary embodiments of the present invention, the width of the initialization voltage line 192 is increased as the number of gate electrodes is increased. For example, since the number of gate electrodes of the fourth pixels 330 is larger than the number of gate electrodes of the first pixel 310, a width a2 of the initialization voltage line 192 of the fourth pixel 330 is larger than a width a1 of the initialization voltage line 192 of the first pixel 310.

As described above, in the organic light emitting diode display according to some exemplary embodiments of the present invention, the number of serial gates is increased in a portion which is vulnerable to flicker and the leakage current to include the leakage current compensation element. When the serial gate is added, an on-current Ion of the transistor is lowered to deteriorate an initialization voltage (Vinit) charging capacity, thereby increasing stain. Therefore, the IR drop of the initialization wire is predicted by left and right test patterns of a panel, and the number of serial gates may be optimized based on the prediction.

Further, in the organic light emitting diode display according to some exemplary embodiments of the present invention, as the number of serial gates is changed, the thickness of the initialization wire may also vary. Therefore, in the organic light emitting diode display according to some exemplary embodiments of the present invention, the width of the initialization voltage line vary depending on the number of gate electrodes of the initialization transistor and the compensation transistor, or the position of the panel, to minimize or reduce the IR drop of the initialization wire, prevent or substantially prevent flicker caused by the leakage current, and/or minimize or reduce a possibility of stain caused by insufficient initialization voltage.

As described above, in the organic light emitting diode display according to some exemplary embodiments of the present invention, the compensation transistor and the initialization transistor are formed to have a plurality of gate electrodes to minimize or reduce the leakage current of the compensation transistor and the initialization transistor, thereby reducing flicker.

Further, in the organic light emitting diode display according to some exemplary embodiments of the present invention, the initialization voltage drop is measured and the compensation transistor and the initialization transistor having different numbers of gate electrodes are differentially disposed for every panel position in order to compensate for the measured voltage drop. Further, the width of the initialization wire varies, to provide an environment where a possibility of stain caused by the initialization voltage drop is minimized or reduced.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims, and their equivalents.

What is claimed is:

1. An organic light emitting diode display, comprising:

a substrate;

a scan line and a previous stage scan line on the substrate and configured to transmit scan signals;

a data line and a driving voltage line crossing the scan line and configured to transmit a data voltage and a driving voltage, respectively;

an initialization transistor connected to the previous stage scan line and the driving voltage line, and comprising an initialization drain electrode connected to a driving gate electrode of a driving transistor;

a compensation transistor connected to the scan line and comprising a compensation drain electrode connected to the initialization drain electrode; and an organic light emitting diode electrically connected to the driving transistor, wherein at least one of the initialization transistor and the compensation transistor comprises a plurality of gate electrodes, wherein the initialization transistor comprises:

a first initialization transistor comprising a first initialization channel, a first initialization gate electrode, a first initialization source electrode, and a first initialization drain electrode; and a second initialization transistor comprising a second initialization channel, a second initialization gate electrode, a second initialization source electrode, and a second initialization drain electrode, a third initialization transistor comprising a third initialization channel, a third initialization gate electrode, a third initialization source electrode, and a third initialization drain electrode, and a fourth initialization transistor comprising a fourth initialization channel, a fourth initialization gate electrode, a fourth initialization source electrode, and a fourth initialization drain electrode.

2. The organic light emitting diode display of claim 1, wherein:

the initialization transistor further comprises:

a fifth initialization transistor comprising a fifth initialization channel, a fifth initialization gate electrode, a fifth initialization source electrode, and a fifth initialization drain electrode.

3. The organic light emitting diode display of claim 2, wherein:

the compensation transistor comprises:

a first compensation transistor comprising a first compensation channel, a first compensation gate electrode, a first compensation source electrode, and a first compensation drain electrode; and a second compensation transistor comprising a second compensation channel, a second compensation gate electrode, a second compensation source electrode, and a second compensation drain electrode.

4. The organic light emitting diode display of claim 3, wherein:

the compensation transistor further comprises:

a third compensation transistor comprising a third compensation channel, a third compensation gate electrode, a third compensation source electrode, and a third compensation drain electrode.

5. The organic light emitting diode display of claim 1, wherein:

the compensation transistor comprises:

a first compensation transistor comprising a first compensation channel, a first compensation gate electrode, a first compensation source electrode, and a first compensation drain electrode; and a second compensation transistor comprising a second compensation channel, a second compensation gate electrode, a second compensation source electrode, and a second compensation drain electrode.

6. The organic light emitting diode display of claim 5, wherein:

the compensation transistor further comprises:

a third compensation transistor comprising a third compensation channel, a third compensation gate electrode, a third compensation source electrode, and a third compensation drain electrode.

7. The organic light emitting diode display of claim 1, wherein:

the compensation transistor comprises:

a first compensation transistor comprising a first compensation channel, a first compensation gate electrode, a first compensation source electrode, and a first compensation drain electrode; and a second compensation transistor comprising a second compensation channel, a second compensation gate electrode, a second compensation source electrode, and a second compensation drain electrode.

8. The organic light emitting diode display of claim 7, wherein:

the compensation transistor further comprises:

a third compensation transistor comprising a third compensation channel, a third compensation gate electrode, a third compensation source electrode, and a third compensation drain electrode.

9. The organic light emitting diode display of claim 1, wherein:

the compensation transistor comprises:

a first compensation transistor comprising a first compensation channel, a first compensation gate electrode, a first compensation source electrode, and a first compensation drain electrode; and a second compensation transistor comprising a second compensation channel, a second compensation gate electrode, a second compensation source electrode, and a second compensation drain electrode.

10. The organic light emitting diode display of claim 9, wherein:

the compensation transistor further comprises:

a third compensation transistor comprising a third compensation channel, a third compensation gate electrode, a third compensation source electrode, and a third compensation drain electrode.

11. The organic light emitting diode display of claim 1, wherein:

the organic light emitting diode display comprises a plurality of pixels, and the plurality of pixels comprises:

a first pixel comprising an initialization transistor comprising two initialization gate electrodes, and a compensation transistor comprising two compensation gate electrodes;

a second pixel comprising an initialization transistor comprising three initialization gate electrodes, and a compensation transistor comprising two compensation gate electrodes; and a third pixel comprising an initialization transistor comprising three initialization gate electrodes, and a compensation transistor comprising three compensation gate electrodes.

12. The organic light emitting diode display of claim 11, wherein:

the plurality of pixels further comprises:

a fourth pixel comprising an initialization transistor comprising four initialization gate electrodes, and a compensation transistor comprising three compensation gate electrodes.

13. The organic light emitting diode display of claim 12, wherein:

the plurality of pixels further comprises:

a fifth pixel comprising an initialization transistor comprising five initialization gate electrodes, and a compensation transistor comprising three compensation gate electrodes.

14. The organic light emitting diode display of claim 13, wherein: the first pixel to the fifth pixel are disposed for every substrate position corresponding to a voltage drop of an initialization voltage.

15. The organic light emitting diode display of claim 11, further comprising:

an initialization voltage line configured to transmit an initialization voltage through the initialization transistor to initialize the driving transistor.

16. The organic light emitting diode display of claim 15, wherein: a width of the initialization voltage line varies according to a number of gate electrodes of the initialization transistor and the compensation transistor, or a position of a panel.

17. The organic light emitting diode display of claim 16, wherein:

the width of the initialization voltage line increases as the number of gate electrodes is increased.

* * * * *